United States Patent [19]

Marchetti

[11] Patent Number: 4,853,073

[45] Date of Patent: Aug. 1, 1989

[54] ADHESIVE TAPE CUTTING DEVICE FOR TAPING UNIT

[76] Inventor: Augusto Marchetti, Via Caccialepori, 35-20148 Milan, Italy

[21] Appl. No.: 165,710

[22] Filed: Mar. 8, 1988

[30] Foreign Application Priority Data

Oct. 23, 1987 [IT] Italy ..... 22393 A/87

[51] Int. Cl.[4] ..... B32B 31/18

[52] U.S. Cl. ..... 156/510; 156/522; 83/284; 83/523; 83/582

[58] Field of Search ..... 156/502, 510, 522, 443, 156/447; 83/284, 523, 582

[56] References Cited

U.S. PATENT DOCUMENTS 4,274,903 6/1981 Mock ..... 156/522

4,759,819 7/1988 Ingram ..... 156/443

*Primary Examiner*—Caleb Weston

*Attorney, Agent, or Firm*—Cushman, Darby & Cushman

[57] ABSTRACT

The adhesive tape cutting device includes a cutting blade constrained to a moving support which guides the blade to intercept the tape at a predetermined point on the path of travel of the tape. The blade is constrained in a yielding manner to the support in such a manner that the blade, following its engagement with the tape, is entrained by the latter and then, due to the yielding nature of its constraint with the support, follows the travel of the tape until completion of the tape cut.

8 Claims, 5 Drawing Sheets

ADHESIVE TAPE CUTTING DEVICE FOR TAPING UNIT

BACKGROUND OF THE INVENTION

The present invention relates to an adhesive tape cutting device for a taping unit.

The prior art includes a taping unit provided with a cutting device consisting of a blade with pointed cutting teeth which is integral with a lever made to rotate at the moment the box being sealed has reached a predetermined point on its path of travel.

An example of such a device is described in Italian patent application no. 23191 A/84 filed by the same applicant as of the present application.

In this device the blade moves in a transverse direction in relation to the tape and, meeting it along its travel as determined by the box, cuts it and at the same time withholds it in its longitudinal movement, thus causing the penetration of the blade teeth into the adhesive tape until breakage thereof is achieve by traction of the remaining part of the resisting tape not yet cut by the blade.

This cutting system, in addition to having a tendency to tear the tape, causes a part of the adhesive material to be withheld by the cutting blade teeth, compromising the cutting effectiveness of said blade. This shortcoming leads to a greater frequency of need for laborious cleaning of the blade.

SUMMARY OF THE INVENTION

In view of this state of the art, the object of the present invention is to accomplish an adhesive tape cutting device which eliminates the aforesaid shortcomings and provides a clean, reliable cut of the tape.

In accordance with the invention this object is achieved by providing an adhesive tape cutting device for taping units comprising a cutting blade constrained to a moving support which guides this blade to interception of the tape at a predetermined point of the path of travel of the tape, characterized in that the constraint between the cutting blade and the associated moving support is of a yielding type in such a manner that the cutting blade, after its engagement with the tape, is moving in relation to the support.

With such an arrangement, the blade, after engaging the tape, is subject to the entrainment effect of the tape, following its travel for a short distance and consequently, remaining in contact with the tape for all the time necessary to secure a complete and accurate penetration of the teeth into the tape until achieving complete separation of the two parts of the tape. The cut takes place progressively, with gentle penetration of the blade teeth into the tape and without causing added tension on the tape. In addition, there being no relative movement between the blade and the tape, not only is there no tearing, but the accumulation of adhesive material on the blade is avoided and, hence, the related shortcomings. Lastly, due to the increased effectiveness of the cutting effect of the device in accordance with the invention, the feed speed of the boxes can be increased.

BRIEF DESCRIPTION OF THE DRAWING

A possible form of practical accomplishment of the present invention is illustrated as a non-limiting example in the annexed drawings wherein.

DETAILED DESCRIPTION

Figure 1:
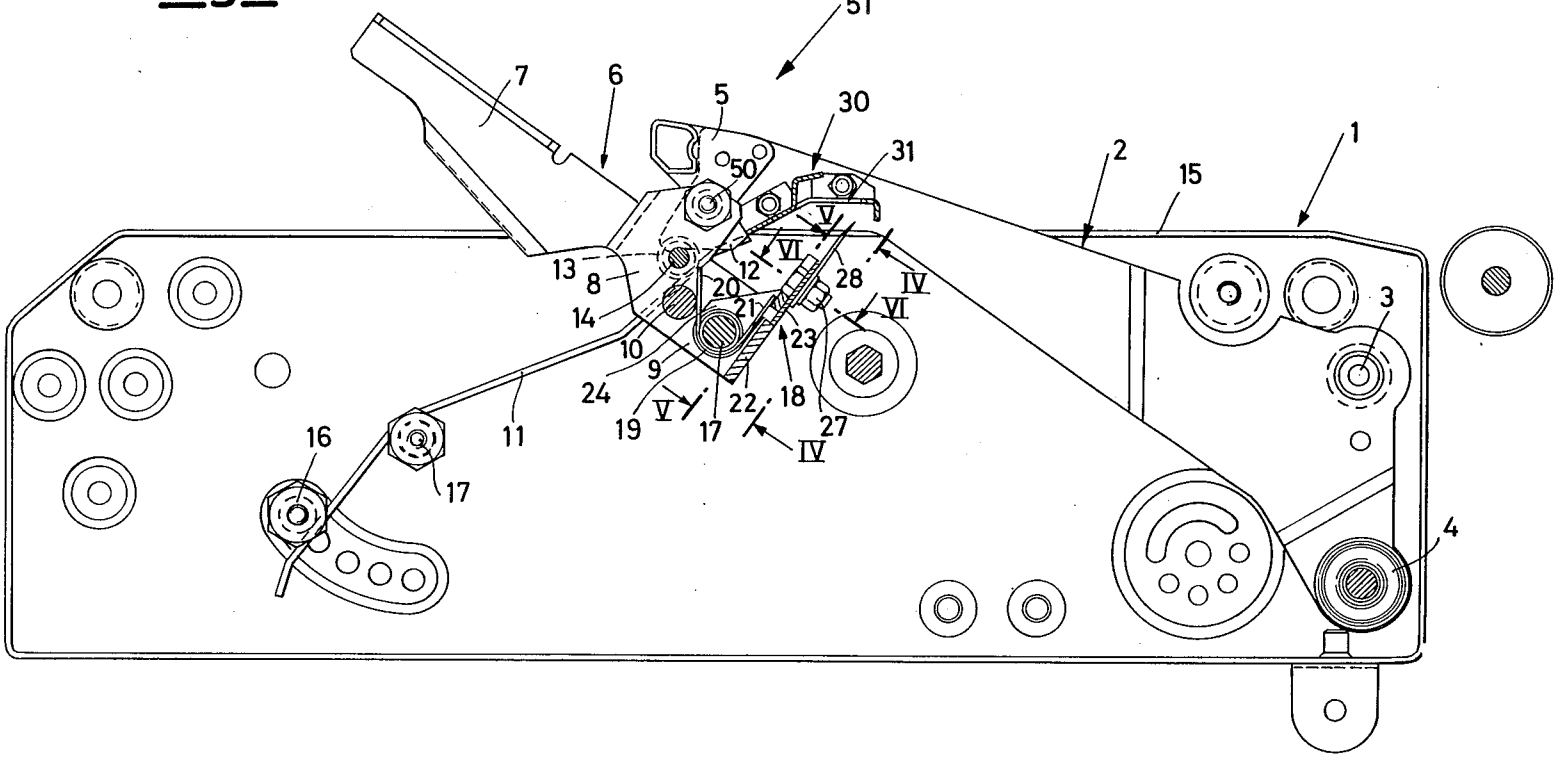
FIG. 1 shows a longitudinal cross-section of an adhesive tape cutting device in accordance with the invention along line I—I of FIG. 2.
Figure 2:
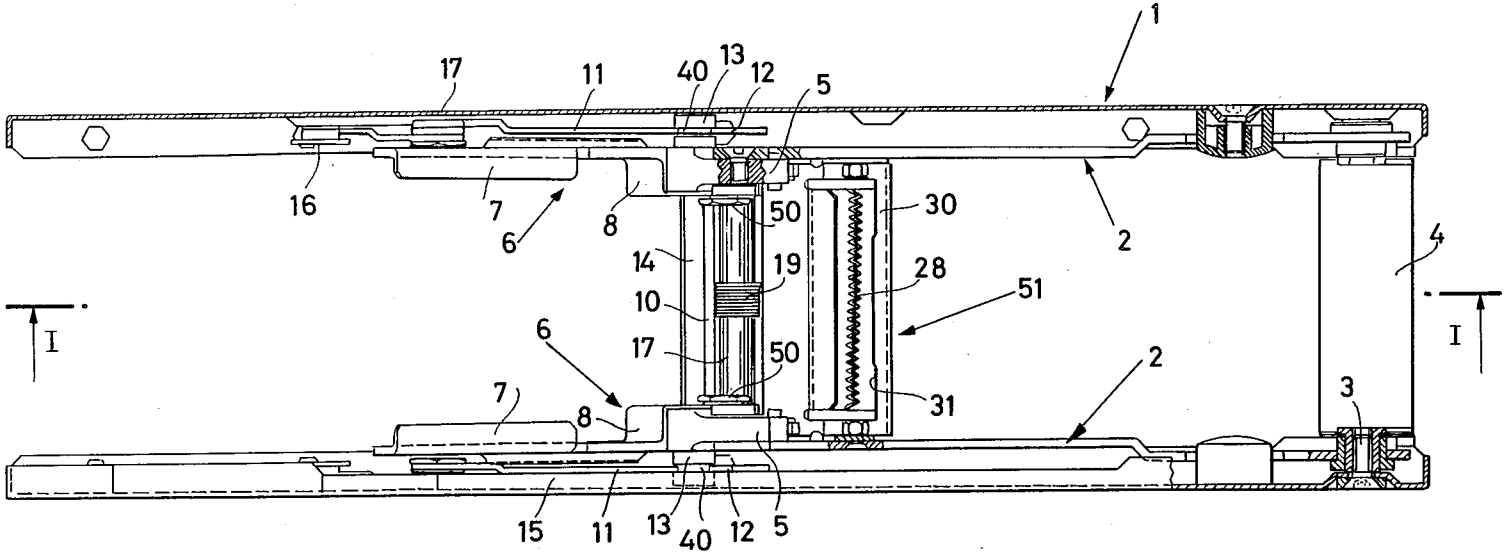
FIG. 2 shows a top plan view of the device.
Figure 3:
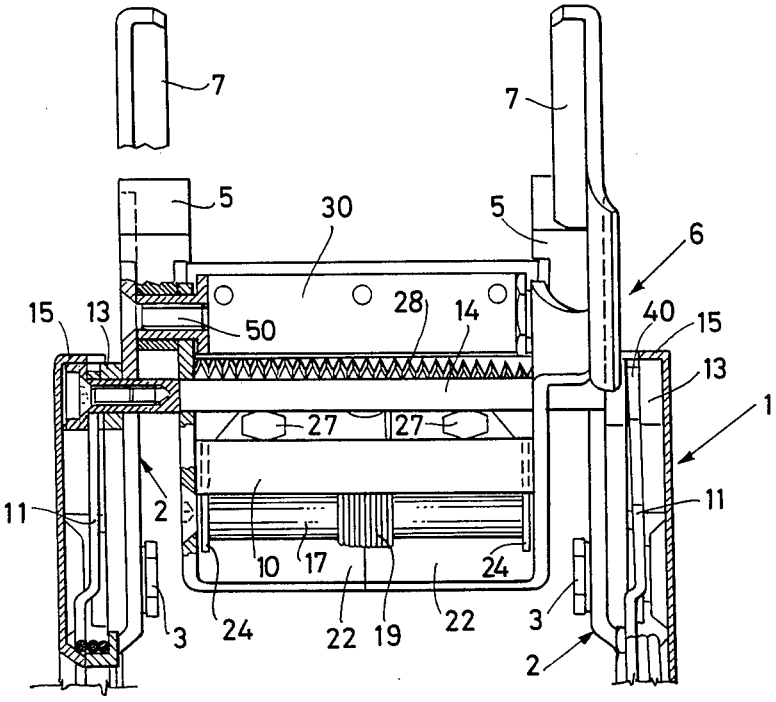
FIG. 3 shows an enlarged partial side view of the device from the left of FIG. 1.

With reference to FIGS. 1 to 3, there is shown an adhesive tape cutting device fitted in a taping unit of which the outer frame is indicated by reference number 1.

The cutting device, indicated as a whole by reference number 51, is constrained in a moving manner to the frame 1 by a pair of side levers 2 pivoted at 3 on the frame 1 and connected by a transverse shaft 4 (FIG. 2).

At the upper ends 5 of the levers 2 are pivoted at 50 two shaped arms 6, each of which includes a front portion 7, a central portion 8 and a rear portion 9. The arms 6 are connected together by a first connecting pin 10, the ends of which are fixed to the central portions 8 of the two arms 6 and are subjected to the effect of respective side springs 11, the upper ends of which ends 12 are engaged in grooves 40 made in the end 13 (FIG. 3) of a second pin 14. The ends 13 are held in respective neutral positions by an upper edge 15 of the frame 1.

The lower ends of the springs 11 are held by respective stop members 16, with adjustable positions, while the central part of each spring is wrapped in pins around a pin 17 fixed to the frame 1.

The rear portions 9 of the arms 6 bear a common pin 17 on which is mounted, in a turning manner, a blade holder 18, which is subject to the effect of a spring 19, which is wound around the central part of the pin 17, and whose heads 20 and 21 exert a pushing action against the pin 10 and the support 18, respectively. The rear portion 9 of the arms 6 is provided with a perpendicular tab 22, placed parallel to the pin 17, in a position such as to provide a stop for the blade holder 18 stressed by the spring 19.

Figure 4:
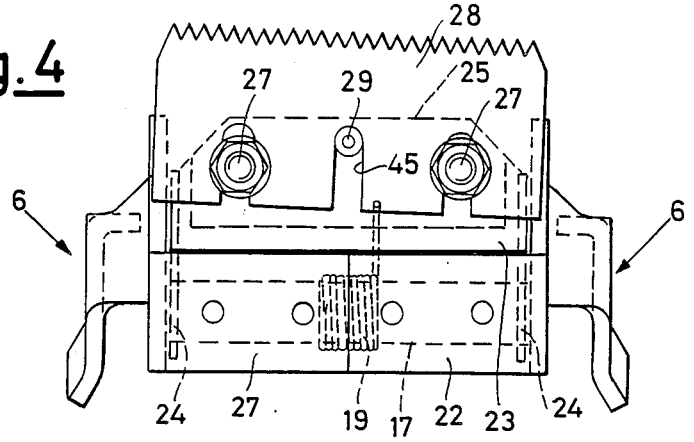
FIG. 4 shows an enlarged front view of the blade and associated support along line IV—IV of FIG. 1.
Figure 5:
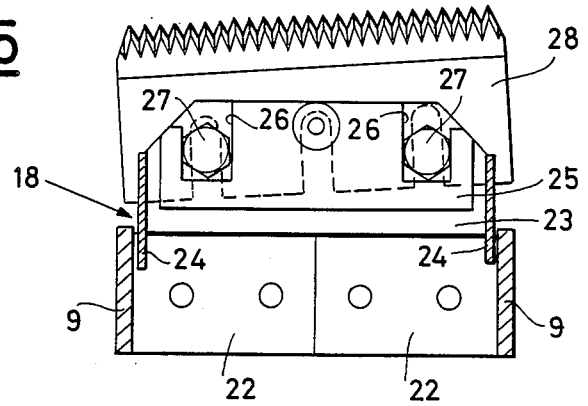
FIG. 5 shows an enlarged cross-section of the blade and associated support along line V—V of FIG. 1.
Figure 6:
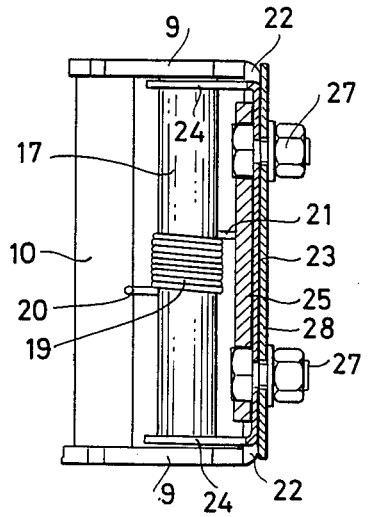
FIG. 6 shows an enlarged cross-section of the blade and associated support along line VI—VI of FIG. 1, and FIGS. 7 to 9 show successive phases of application and cutting of the tape.

As better illustrated in FIGS. 4 to 6, the blade holder 18 consists of a supporting plate 23, provided with side arms 24 pivoted at the ends of the pin 17 and placed along the inner sides of the rear portions 9 of the arms 6, and of a blocking plate 25 having seats 26 designed to receive the heads of locking bolts 27 to fix a blade 28 mounted on the external face of the plate 23. For correct positioning of the blade 28, there is provided on the external face a centering element 29 which fits in a notch 45 (FIG. 4) made in the center of the blade 28. Preferably, the blade is mounted in a slightly inclined manner so that its teeth do not pierce the tape simultaneously. The blade 28 is also provided with a protective screen 30 having an opening 31 to permit passage of the blade 28 in the phases of approach to the tape and cutting. The screen 30 is constrained to said side levers 2.

The embodiment shown is the preferred one, but it is clear that a different type of yielding constraint can be provided between the blade and the support. For example, in place of the spring 19 between the plate 23 and the pair of levers 6, there can be employed an elastic means placed directly between the blade 28 and the associated support 6.

Figure 7:
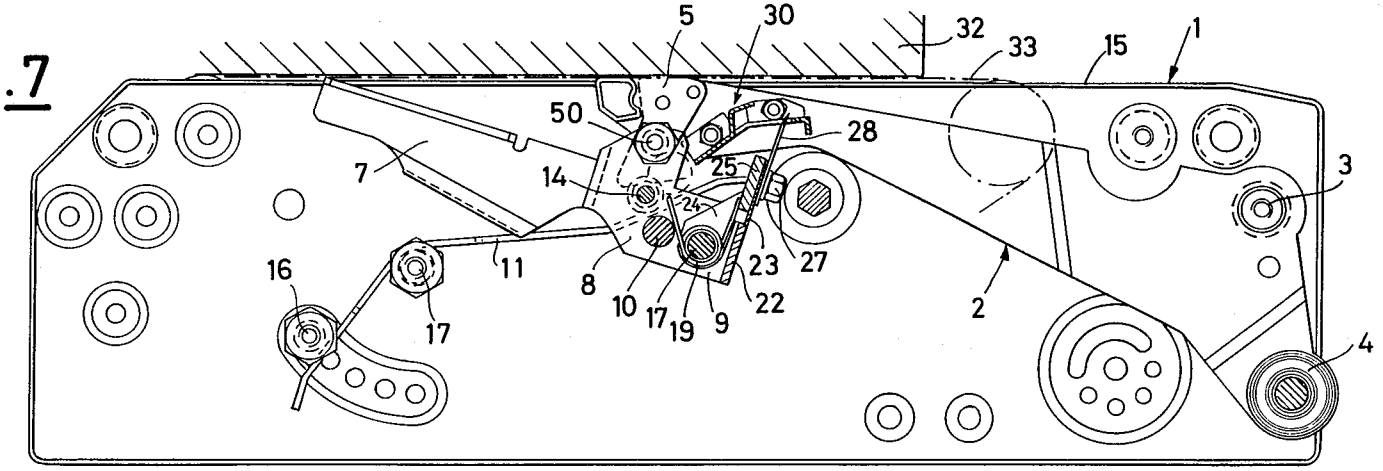

The cutting device described is designed to operate as follows:

As shown in FIG. 7, while a strip of tape 33 is being applied to the bottom of a box 32, due to the entrainment effect (in a known manner) of said advancing box, the levers 2 are in retracted positions inside the frame 1 and press against the bottom of the box, due to the effect exerted by the side springs 11 on the pin 14 constrained to the arms 6. The blade 28 is also in a retracted position.

Figure 8:
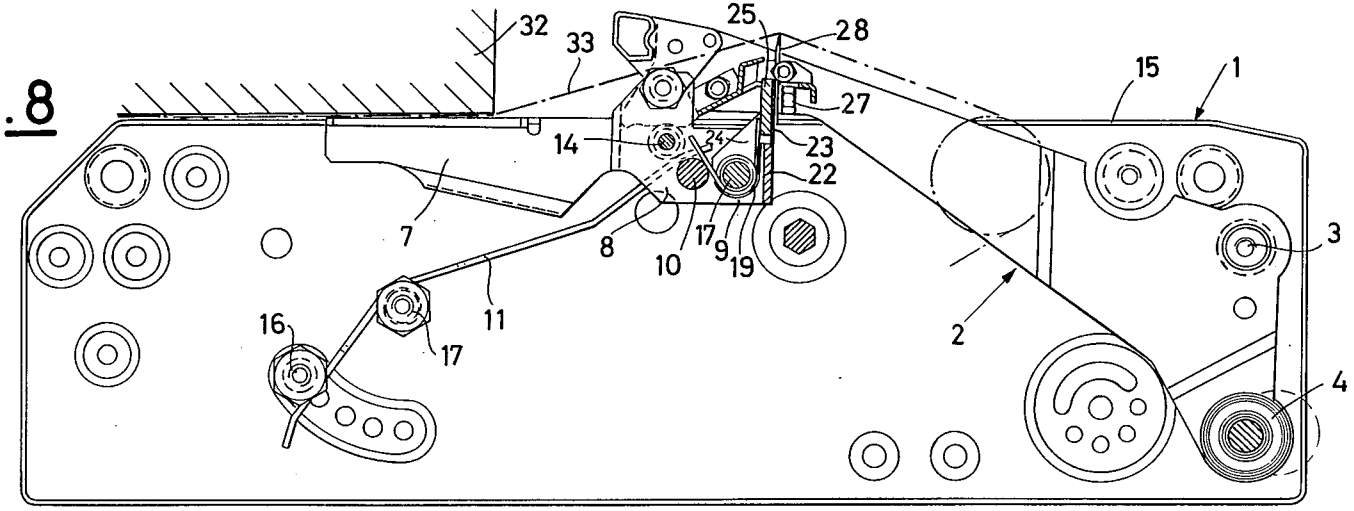

When the box 32 passes the upper ends 5 of the levers said levers, due to the effect of, the springs 11, emerge from the inner space of the frame 1 and entrain with them the central portions 8 and rear portions 9 of the arms 6, which rotate around the pins 50 until they reach a position at the end of their travel in which the ends 13 of the pin 14 stop against the upper edges 15 of the frame 1, while the front portions 7 of the arms 6 are held beneath the bottom of the box (FIG. 8).

Rotation of the arms 6 cause simultaneous extraction of the blade 28 which, as shown in FIG. 8, engages the tape 33 and causes its teeth to penetrate gradually into the tape.

Figure 9:
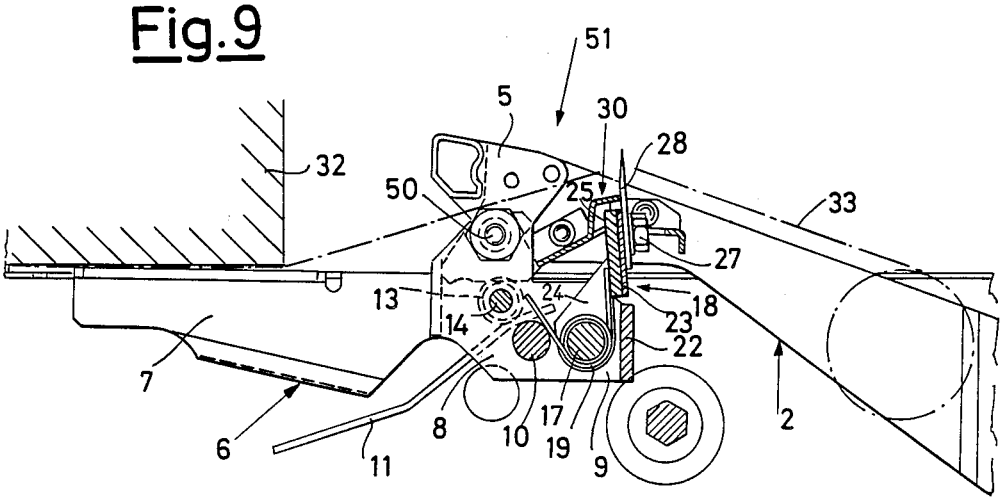

At this point, the tape 33, which is continuously entrained by the box 32 but is not yet cut, exerts on the blade an entrainment effect due to which the blade 28, overcoming the resistance of the spring 19, rotates slightly around the pin 17, accompanying the travelling movement of the tape until the teeth thereof complete the cutting of the tape (FIG. 9).

I claim:

1. An adhesive tape cutting device for taping unit comprising:

a cutting blade constrained to a moving support which guides said blade to intercept the tape at a predetermined point on a path of travel of the tape;

constraint means provided between said blade and the associated support being of a yielding type in such a manner that said blade, following engagement of said blade with the tape, moves in an advancing direction along said path of travel, in relation to said support.

2. A device in accordance with claim 1, wherein:

said blade is fitted in a blade holder connected in an elastically yielding manner to said moving support.

3. A device in accordance with claim 2, wherein:

said moving support is constituted by a pair of shaped arms connected together.

4. A device in accordance with claim 3, wherein:

said blade holder is mounted in a turning manner on a pin connecting said arms; and said device further includes a spring which holds said blade holder in a predetermined neutral position in relation to said moving support.

5. A device in accordance with claim 4, wherein:

said shaped arms include transverse extensions; and said blade holder, when in said neutral position, is butted against said transversal extensions of said shaped arms.

6. A device in accordance with claim 4, wherein:

said blade holder is constituted by a supporting plate provided with arms pivoted on said pin, and a locking plate provided with openings for passage of bolts for fixing said blade to said blade holder.

7. A device in accordance with claim 6, wherein:

said supporting plate is provided with a centering element for centering said blade.

8. A device in accordance with claims 1, wherein:

said blade is mounted directly in an elastically yielding manner on said moving support.

* * * * *